US005826384A

United States Patent [19]

O'Neill

[11] Patent Number: 5,826,384

[45] Date of Patent: Oct. 27, 1998

[54] MODULAR TRUSS SYSTEM

[75] Inventor: Edward L. O'Neill, Castro Valley, Calif.

[73] Assignee: Lucasey Manufacturing Company, Oakland, Calif.

[21] Appl. No.: 748,333

[22] Filed: Nov. 12, 1996

[51] Int. Cl.[6] ..... E04C 5/08

[52] U.S. Cl. ..... 52/223.9; 52/223.1; 52/645

[58] Field of Search ..... 52/223.9, 223.8, 52/645, 646, 649.5, 650.1, 726.1, 730.4, 730.5, 223.1, 223.11, 223.12, 223.13, 223.14

[56] References Cited

U.S. PATENT DOCUMENTS

| | | | |
|---|---|---|---|
| 1,537,589 | 5/1925 | Dawson et al. | 52/223.9 |
| 3,418,768 | 12/1968 | Cardan . | |
| 4,259,825 | 4/1981 | Hedgepeth et al. | 52/645 |
| 4,308,699 | 1/1982 | Slysh . | |
| 4,637,193 | 1/1987 | Lange . | |
| 4,641,477 | 2/1987 | Schleck . | |
| 4,694,621 | 9/1987 | Locke | 52/726.1 |
| 4,819,399 | 4/1989 | Onoda . | |
| 5,040,349 | 8/1991 | Onoda et al. . | |
| 5,076,724 | 12/1991 | Silber . | |
| 5,078,534 | 1/1992 | White . | |
| 5,111,631 | 5/1992 | Flood et al. . | |
| 5,125,206 | 6/1992 | Motohashi et al. . | |
| 5,163,262 | 11/1992 | Adams . | |
| 5,205,101 | 4/1993 | Swan et al. | 52/650.1 |
| 5,214,899 | 6/1993 | Beeche et al. . | |
| 5,228,258 | 7/1993 | Onoda et al. . | |
| 5,269,106 | 12/1993 | Stafford et al. . | |
| 5,301,482 | 4/1994 | Aspenwall | 52/223.8 X |
| 5,363,625 | 11/1994 | Philippi . | |
| 5,388,376 | 2/1995 | Henri . | |
| 5,390,463 | 2/1995 | Sollner . | |
| 5,439,310 | 8/1995 | Evenson et al. . | |
| 5,509,543 | 4/1996 | Weaver et al. . | |

FOREIGN PATENT DOCUMENTS

| | | |
|---|---|---|
| 428-874-A | 5/1991 | European Pat. Off. . |
| 2471-461 | 6/1981 | France . |

*Primary Examiner*—Creighton Smith
*Attorney, Agent, or Firm*—Niro, Scavone, Haller & Niro

[57] ABSTRACT

A modular truss system that is formed by connecting a plurality of linear and non-linear truss modules together. The truss system further including a tensional member that is adapted to create and maintain a biasing force that urges the individual truss modules against one another, which forms a more rigid system that has increased structural strength.

27 Claims, 3 Drawing Sheets

MODULAR TRUSS SYSTEM

BACKGROUND OF THE INVENTION

The present invention relates to a modular truss system and, more particularly, to a modular truss system that employs an internal tensional member that increases the strength of the assembled truss system and promotes a seamless appearance by creating a more rigid truss system.

Truss systems are employed in a wide variety of tasks in which a free standing structure is needed. Uses range from structures intended for use at stage presentations to indoor displays that are often used at trade shows or by merchandisers to display wares. Moreover, truss systems that may employ non-linear sections would be desirable since such structures would enhance the visual appeal of the truss structure.

SUMMARY OF THE INVENTION

The present invention is, therefore, directed to a modular truss system that employs a tensional member that biases the individual modules towards one another and maintains the biasing force during use of the system. It has been found that this biasing force creates a more rigid structure with enhanced structural strength. This not only increases the load bearing capacity of the system, it also allows for the use of linear and non-linear truss modules as well as the use and formation of multiple truss branches without compromising the strength of the system.

Moreover, providing a system with enhanced structural strength also allows for a truly versatile and modular system. The present invention is ideally suited to be composed of modules of standard lengths and curvatures, such as 30, 45, and 90 degrees, which may then be configured into a wide range of combinations. This type of versatility is beneficial since it would allow a user to vary the design of the truss system without the need to have a custom truss system fabricated for each specific layout.

BRIEF DESCRIPTION OF THE DRAWINGS

The novel features which are characteristic of the present invention are set forth in the appended claims. The invention itself, however, together with further objects and attendant advantages, will be best understood by reference to the following description taken in connection with the accompanying drawings in which:

DETAILED DESCRIPTION OF THE PREFERRED EMBODIMENTS

Figure 1:
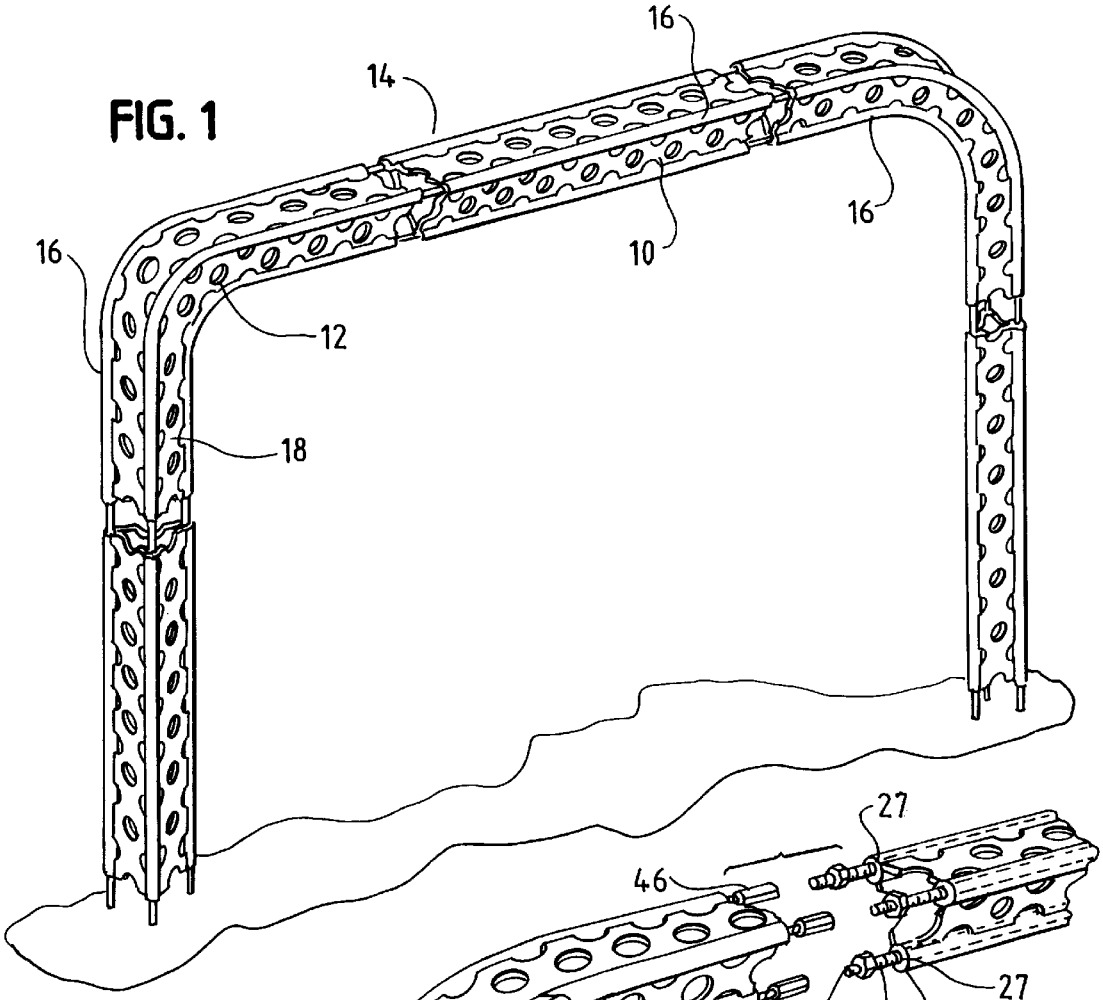
FIG. 1 is a perspective view of a modular truss system employing both linear and non-linear modules.

As shown in FIG. 1, linear truss module 10 and non-linear truss module 12 may be connected to form a modular truss system 14. Each module is comprised of transversely spaced structural members 16 that are elongated and generally tubular in nature. However, persons of ordinary skill in the art would recognize that other non-tubular members such as solid rods, I-beams, and open channels may be used as structural members as well. A web 18 is typically welded to members 16 and acts to hold members 16 together in spatial alignment.

Figure 2:
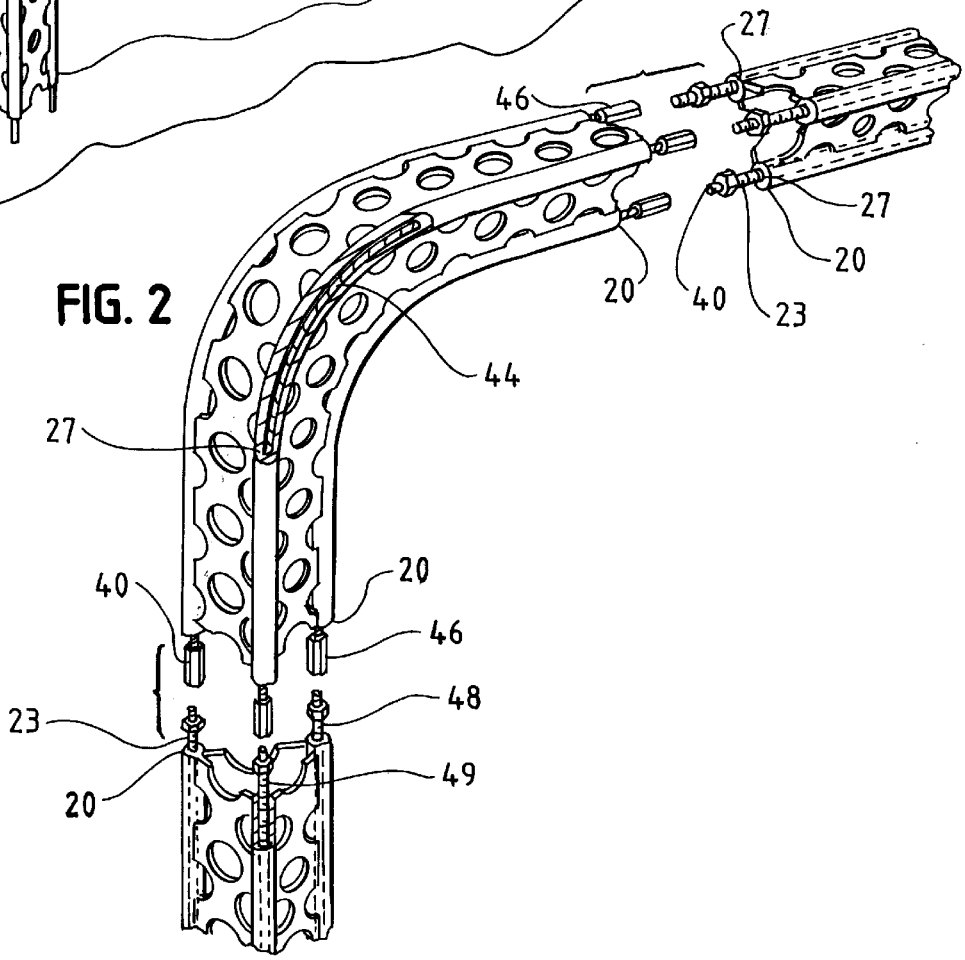
FIG. 2 is an exploded perspective view with portions removed showing the use of a flexible tensional member.
Figure 3:
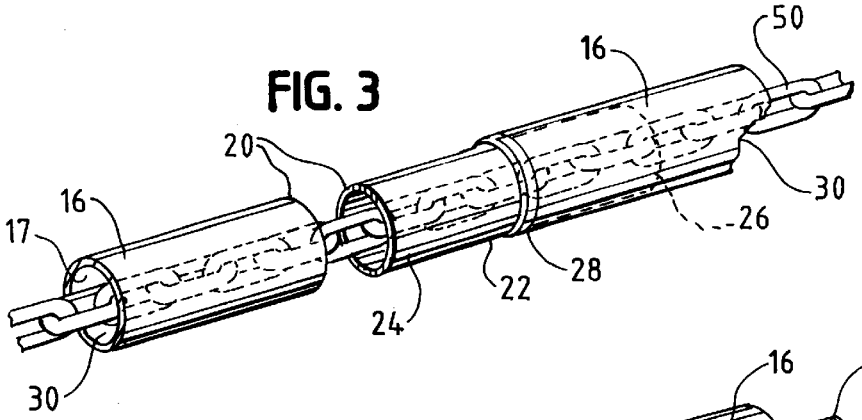
FIG. 3 is an enlarged perspective view illustrating how an insert may be used to facilitate the attachment of the individual truss modules.
Figure 4:
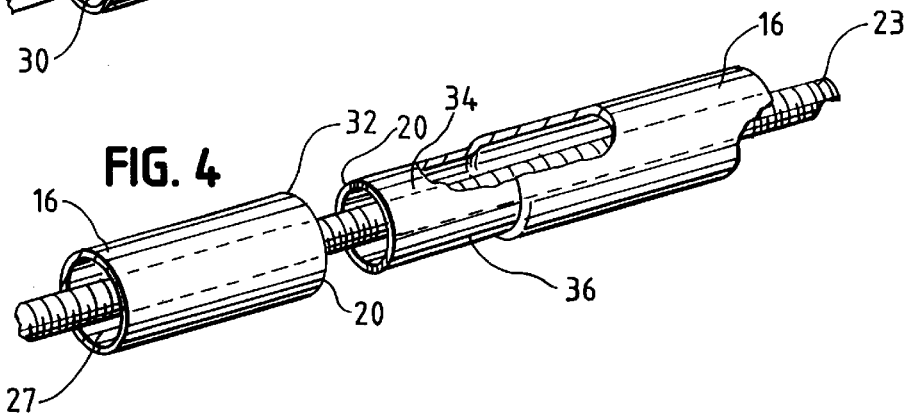
FIG. 4 is an enlarged perspective view showing how a male/female relationship may be used to connect the individual truss modules.

As shown in FIGS. 2, 3 and 4, each member 16 terminates in ends 20. Truss system 14 is constructed by arranging modules 10 and 12 and members 16 end to end and by abutting and joining corresponding ends 20 together in an axial relationship. As shown in FIG. 3, a connector 22, having opposing ends 24 and 26 with a boss 28, may be used to assist in connecting the modules together. Ends 24 and 26 of connector 22 are sized to securely fit within apertures 30 created at ends 20.

FIG. 4 shows an alternative method by which the individual truss modules may be axially aligned and connected together. In this embodiment, side 32 of member 16 terminates in ends 20 while the opposite side 34 terminates in ends 36 that are sized to fit within the inner diameter of ends 20. In this manner, as the individual truss elements are connected, ends 32 and 34 are sized to telescopically fit together in a male/female relationship.

Figure 6:
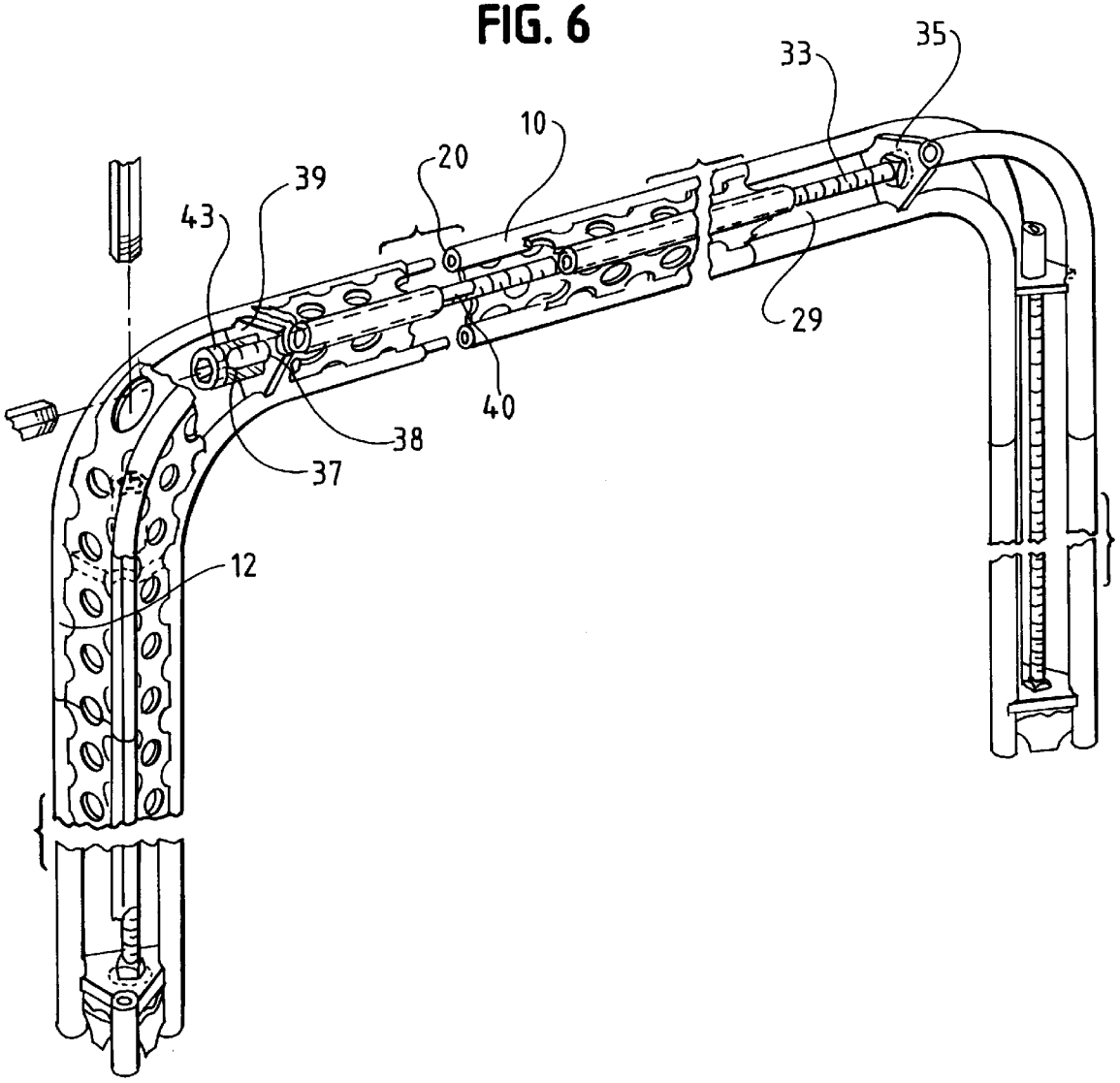
FIG. 6 is a perspective view, with portions removed, illustrating an embodiment in which the tensional member is located in an interior space formed by the web of the individual truss modules.

The invention also includes a tensional member 40 that may be located in the interior space 27 formed by members 16 or, as shown in FIG. 6, in the interior space 29 formed by members 16 and webs 18. Tensional member 40 is used to apply a force that biases the individual truss modules together and maintains the force during use which adds strength to the system by creating a more rigid system.

This force also promotes a seamless appearance by using the biasing force to maintain the abutting relationship of ends 20. This prevents even slight separations between ends 20 from occurring due to the loads placed upon the truss during usage. Once separations occur, the seamless appearance of the system is diminished.

As shown in FIG. 6, tensional member 40 may be located in interior space 29 and consist of rod 31 which is affixed to an opposingly located truss modules. This may be accomplished by first affixing end 33 of rod 31 to a plate 35 located in an opposing truss module through use of a threaded connection, welding or pinning. Of course other methods known to those of ordinary skill in the art for releasably and permanently affixing rod 31 would be within the scope of this invention.

As further shown in FIG. 6, opposing threaded end 37 of rod 31 is positioned to pass through an aperture 38 in plate 39 which is located on an opposingly located truss module. A biasing force is created and maintained by placing a threaded fastener 43 or a similar device onto threaded end 37 and tightening fastener 43, which creates a force that biases the truss modules together.

In another embodiment, a flexible tensional member may be used. This tensional member which may be a steel cable 44 as shown in FIG. 2, linked chain elements 50 as shown in FIG. 3, and a combination of flexible and rigid elements 23 as further shown in FIGS. 2 and 4. Of course, persons of ordinary skill would also recognize that other elements may be also used to form the tensional member. This type of tensional member may also be used in either interior space 29 or in interior space 27.

To facilitate threading the tensional member through interior space 27 of member 16, the tensional member may be segmented into workable, smaller lengths as shown in FIG. 2. As shown, each length may then be connected by the use of rigid threaded elements or couplings which may be internally threaded 46, externally threaded 48, or threaded rods 49. Once connected in this manner, the tensional member may consist of a series of flexible segments, threaded fasteners, and rigid segments.

Figure 7:
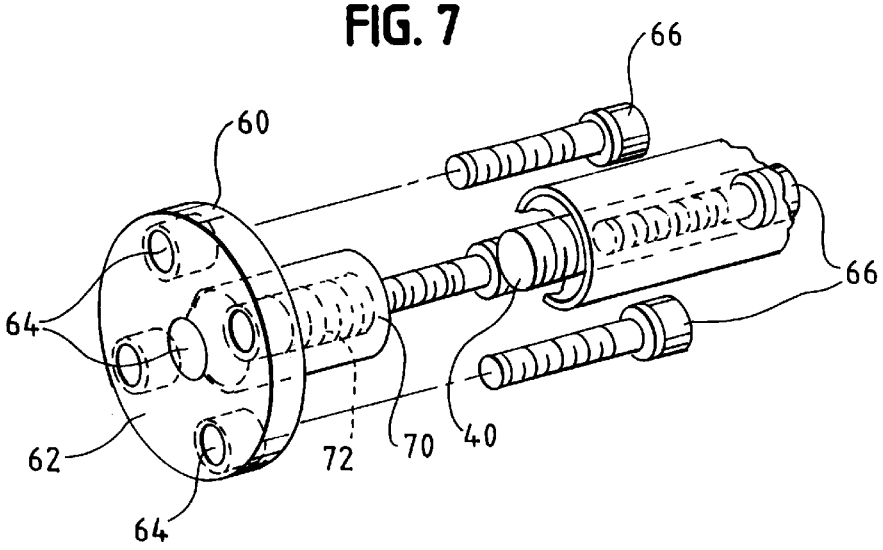
FIG. 7 shows an exploded perspective view of the tightening mechanism.

To create the biasing force, a tightening mechanism 60 is employed. As shown in FIG. 7, mechanism 60 consists of a base 62 having mounting holes 64 that fasteners 66 may pass through in order to facilitate the mounting of the truss system to a support surface.

Tightening mechanism 60 further includes a projection 70 that has a set of internal threads 72 that are sized to receive a threaded portion from the tensional member. Tension is produced by either rotating mechanism 60, the threaded portion of the tensional member, or both. This then causes a biasing force that urges the modules together thereby creating a rigid system with enhanced load bearing strength. Of course, persons of ordinary skill in the art work know that other means for creating the biasing force could be used. Such devices as cranks, winches or hydraulic drives may be used as well.

Maintaining the biasing force during the operation of the system not only binds the modules together to form a more rigid system, it also helps to promote a seamless appearance. It has been found that the biasing force increases the strength of the truss and thereby increases the load bearing capacity of the system over that associated with other truss systems.

Figure 5:
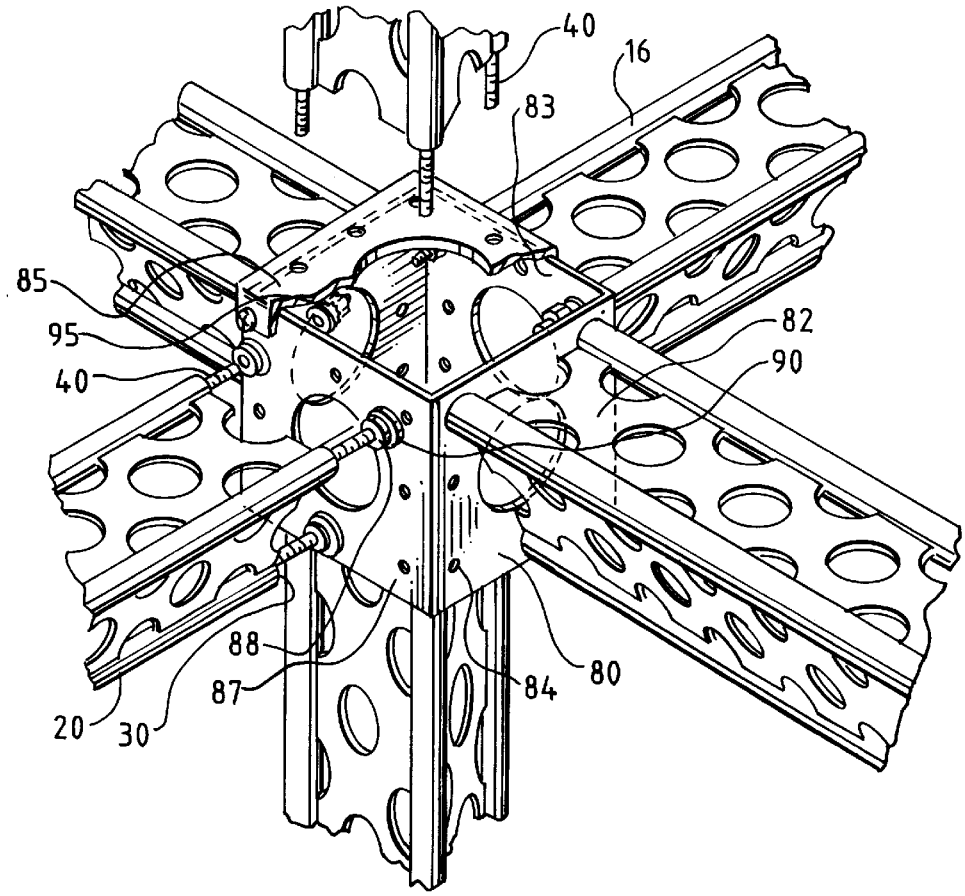
FIG. 5 is a perspective view illustrating how a junction box may be used to create multiple truss branches.

Since the use of a tensional member imparts added strength to truss system 14, as was stated above, non-linear modules 12 may be used with the system without a significant loss in the system's strength or load bearing capacity. Moreover, using a tensional member allows for the branching of truss modules from a junction 80 as shown in FIG. 5.

As shown, junction 80 consisting of opposing sidewalls 82, 83, 85, and 87 and mounting apertures 84 that are used to affix the truss branches to junction 80. Other configurations having 2, 6, 8 or some other number of sides may also be used to form junction 80 as well. As further shown in FIG. 5, junction 80 may include a plurality of apertures 84 which will allow the modules to be mounted in several different orientations.

A method by which truss modules may be mounted to junction 80 includes the use of washers 88 that facilitated mounting. As may be seen, a portion of washer 88 is sized to fit within aperture 30 of end 20 while an opposing end includes an expanded stop 90 that either abuts against a wall of junction 80 or is permanently affixed to junction 80. Tensional member 40 may then affixed to junction 80 by the use of a threaded fastener 95.

It will be appreciated by those skilled in the art that various changes and modifications can be made to the illustrated embodiments without departing from the spirit of the present invention. All such modifications and changes are intended to be covered by the appended claims.

What is claimed is:

1. A modular truss system comprising:

at least two opposingly located and matingly connectable truss modules;

a plurality of flexible tensional members securingly received by each of said truss modules; and said flexible tensional members develop a force that biases said truss modules towards one another and to maintain said biasing force during the use of said truss system to increase the load bearing capacity of said truss system.

2. The device of claim 1 wherein said truss modules are either linear or non-linear in configuration.

3. The device of claim 1 wherein said truss modules define an interior space and said tensional member is located within said interior space.

4. The device of claim 1 wherein said truss modules are telescopically connected together during the operation of said truss system.

5. The device of claim 1 wherein each of said tensional members is enclosed within a continuous tubular space that is created by the connection of said truss modules.

6. The device of claim 1 wherein said tensional members comprise either a cable or a chain.

7. The device of claim 1 wherein said tensional members are comprised of flexible segments that are connected by threaded fasteners to rigid elements.

8. The device of claim 1 wherein said tensional members are in engagement with all said truss modules comprising said truss system.

9. The device of claim 1 wherein said tensional members further include threaded portions adapted to develop said biasing force.

10. A modular truss system comprising:

a plurality of elongated truss modules, each said module including at least two generally parallel and longitudinally extending tubular members rigidly connected by at least one intermediate web;

a plurality of tubular housings created by said tubular members being arranged end to end with their respective ends being axially aligned and matingly connected; and a flexible tensional member extending within each of said tubular housings, said tensional members being operatively associated with said modules to develop and maintain a biasing force that urges said modules together to increase the load bearing capacity of said truss system.

11. The device of claim 10 wherein said truss modules are either linear or non-linear in configuration.

12. The device of claim 10 wherein said truss modules are telescopically connected together.

13. The device of claim 10 wherein said tensional members comprise either a flexible cable or a chain.

14. The device of claim 10 wherein said tensional members are comprised of flexible segments that are connected by threaded fasteners to rigid elements.

15. The device of claim 10 wherein said tensional members are in engagement with all said truss modules comprising said truss system.

16. A modular truss system having multiple branches for supporting a load comprising:

a plurality of matingly connectable truss modules that are opposingly located and assembled together to form a plurality of individual truss branches having predetermined lengths and opposing end portions;

at least one junction adapted to receive and securingly retain an end portion of said individual truss branches wherein said end portions of said individual truss branches converge upon and terminate at said junction;

a plurality of flexible tensional members that are retainingly received by at least one individual truss branch;

said flexible tensional members being adapted to develop and maintain a force that biases at least two truss modules of said individual truss branch towards one another whereby the load bearing strength of said truss branch is increased.

17. The device of claim 16 wherein said truss modules are either linear or non-linear in configuration.

18. The device of claim 16 wherein said truss modules define a plurality of interior spaces and at least one of said plurality of tensional members is located within each of said interior spaces.

19. The device of claim 16 wherein each said individual truss branch includes a plurality of tensional members that are securingly retained by at least two opposingly located truss modules and wherein said tensional members develop a force that biases said truss modules towards one another and maintain said biasing force during the use of said truss branch whereby the load bearing strength of each said truss branch is increased.

20. The device of claim 16 wherein said junction includes apertures designed to be used in connection with threaded fasteners to secure said truss branches to said junction.

21. The device of claim 20 wherein said apertures of said junction are configured to permit said truss branches to be affixed to said junction in a plurality of orientations.

22. The device of claim 16 wherein said truss modules are telescopically connected together.

23. The device of claim 16 wherein said tensional members are enclosed within continuous tubular housings that are created by the connection of said truss modules.

24. The device of claim 16 wherein said tensional members comprise either a flexible cable or a chain.

25. The device of claim 16 wherein said tensional members are comprised of flexible segments that are connected by threaded fasteners to rigid elements.

26. The device of claim 16 wherein said tensional members are in continuous engagement with all said truss modules comprising said truss system.

27. The device of claim 16 wherein said tensional members include threaded portions adapted to use rotational movement to develop said biasing force.

* * * * *